United States Patent [19]

Meschi

[11] Patent Number: 4,832,786

[45] Date of Patent: May 23, 1989

[54] SPLICING DEVICE FOR SHEET MATERIAL

[76] Inventor: Luciano Meschi, Corso Amedeo 73, 57100 Livorno, Italy

[21] Appl. No.: 97,195

[22] Filed: Sep. 16, 1987

[30] Foreign Application Priority Data

Sep. 17, 1986 [IT] Italy ..... 21738 A/86

[51] Int. Cl.[4] ..... B65H 69/06

[52] U.S. Cl. ..... 156/506; 156/157

[58] Field of Search ..... 156/502, 505, 506, 304.3, 156/157

[56] References Cited

U.S. PATENT DOCUMENTS 3,769,140 10/1973 Sayer ..... 156/502
4,289,556 9/1981 Booth ..... 156/506
4,421,590 12/1983 Meschi ..... 156/506
4,526,638 7/1985 Clements ..... 156/505
4,564,184 1/1986 Rumpel ..... 156/507
4,576,673 3/1986 Lenzi ..... 156/502

*Primary Examiner*—Michael Wityshyn
*Attorney, Agent, or Firm*—McAulay, Fields, Fisher, Goldstein & Nissen

[57] ABSTRACT

Apparatus for splicing of sheets, particularly the last sheet of a package feeding a printing device with the first sheet of the next following package. A splicing head is used for applying a length of self-adhesive tape across adjacent edges of the two sheets and for pressing the two sheets into position, by cutting them according to the manner in which the splicing is to be carried out.

21 Claims, 7 Drawing Sheets

10
11
12
13
14
15
16
17
18
19
25
26
27
28A
28B
29A
29B
30A
30B
31
32
51
56
72

SPLICING DEVICE FOR SHEET MATERIAL

The present invention relates to a splicing device for a sheet material and, more specifically to a device for the overhead splicing, by means of self-adhesive tape, of the end sheets of two packages of sheet material, wherein the sheet material is in form of a continuous strip previously folded in an accordion like manner.

It is known that in a number of uses, such as the data processing equipments, the electronic accounting centers and other, fast printers are provided (such as for example the so-called laser printers) which are fed with a writing support comprising single sheets individualized in a continuous accordion like folded strip by cross perforations or weakening lines and by sheet advancement perforations.

It is also known that the high operating rate of the subject printers makes the dead times related to the insertion of the first sheet of a novel form package, when the preceeding one is exhausted, untolerably high.

Otherwise stated, the rate by which a form package of 2-3000 sheets is exhausted is such that the inserting time of a novel package causes the operating rate and consequently the production rate of the printers to be reduced in an untolerable degree.

Consequently in the past there have been proposed and embodied devices for the splicing of the last sheet (or the bottom sheet) of the package from which the printer or the like operating machine is being fed with the first sheet (or the upper sheet) of the immediately next package before the package from which the feeding takes place is exhausted, whereby once it is exhausted the feeding proceeds without practically undergoing interruptions.

As an example of a device of this type it can be cited that disclosed and claimed in the European Patent No. 42619 granted on the application No. 81104840.

The main purpose of the present invention is that of providing an improved and simplified splicing device.

Such a purpose is achieved by means of a splicing device for sheet material, of the type in which two sheets to be spliced, particularly forming the last sheet of a package and the first sheet of the immediately next package, are placed onto a supporting plane at their terminal edges and maintained in position by means engaging the perforations, means being furthermore provided suitable to draw a self-adhesive tape from a source of the same and to apply it across the contacting and the splicing line between the two adjacent sheets, characterized by comprising first pliers means for gripping and carrying forward self-adhesive tape, which are movable along said splicing line above said supporting plane, second means with a pressing roller mounted above said supporting plane and movable along said splicing line, said pliers means comprising first and second gripping elements vertically movable with respect to each other between a removed or releasing position and a closed up or gripping position, said first gripping element being pallet shaped and being vertically positioned below said second gripping element, the latter being mounted to first supporting means comprising controlling means for the displacement of said second gripping element between a raised position and a lower position, said first supporting means being horizontally movable between a rest position staggered with respect to said splicing line and an operating position in which said first and second gripping elements are vertically aligned across said splicing line, said second gripping element being in turn provided with means for the control of the displacement of said first gripping element between said two positions with respect to said second gripping element, said second pressing roller means being mounted to second supporting means provided with control means for the displacement of said pressing means between a first position raised with respect to said supporting plane and a second operating position, in which said supporting plane is engaged with a predetermined pressing force, the latter supporting plane being provided with means for the adjustment of the size of the sheets to be spliced and with means for the cutting of the adhesive tape at the said edges of the two sheets to be spliced.

The peculiar features and advantages of the present invention shall more clearly appear from the following description of a preferred embodiment, made with reference to the enclosed drawings having exemplifying but non limiting purpose, wherein.

Figure 1:
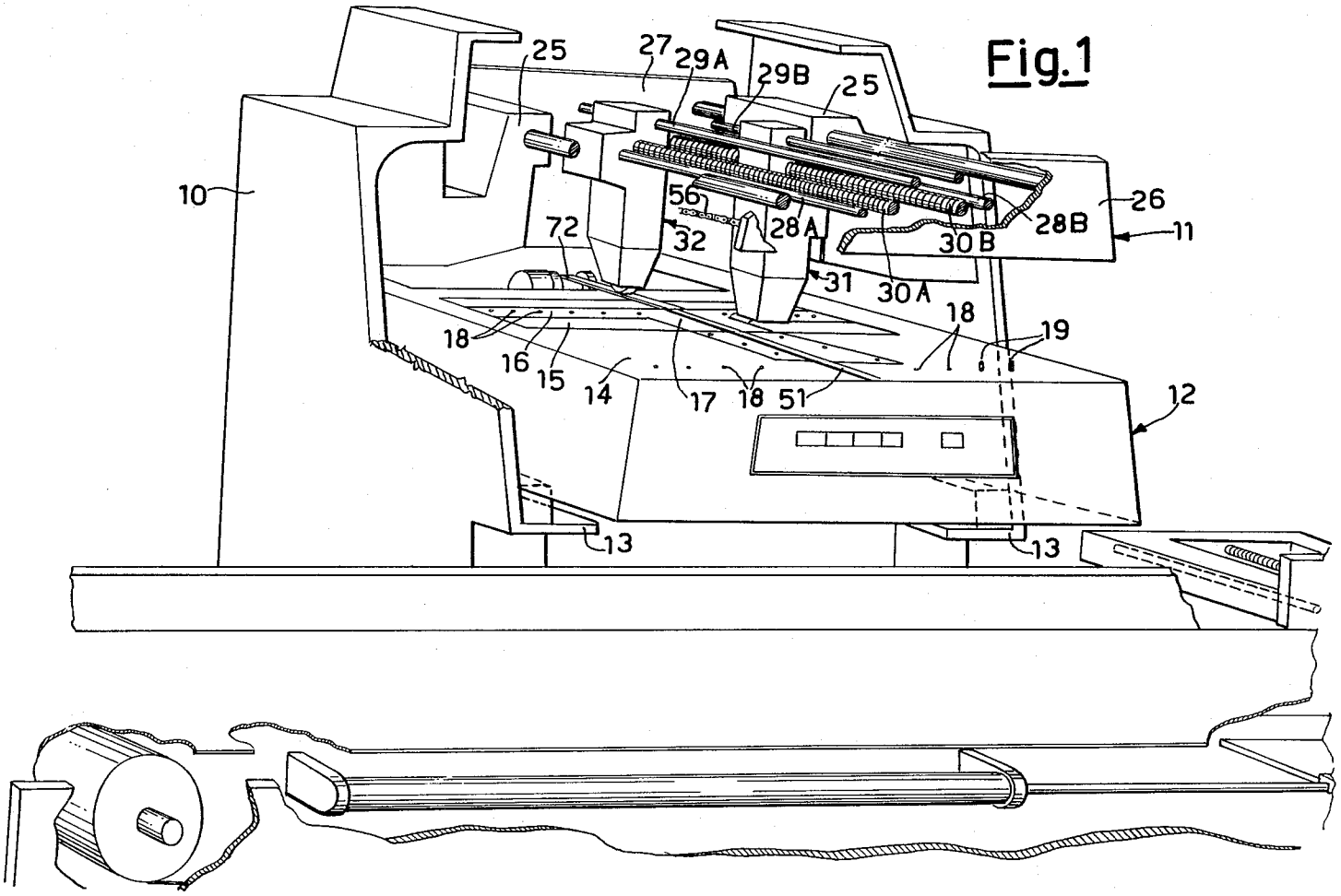
FIG. 1 is a perspective view with some parts partially removed of the splicing device according to the invention.

Referring to the drawings, reference number 10 designates a housing and casing covers for a splicing device 11.

The device 11 comprises a supporting plane 12 slidably mounted onto guiding and sliding brackets 13.

The supporting plane 12 is internally hollow (being formed by a prismatic casing having a substantially trapezoidal cross-section), and its upper surface is formed by a fixed plate 14, wherein an opening 15 is provided. Cross-wise with respect to the opening 15 is a bridge 16 rigidly mounted to a plate 17.

The plate 17, together with the bridge 16, can be displaced parallelly to itself so as to be brought towards or away with respect to the fixed plate 14 and consequently with respect to its terminal edge.

Onto this terminal edge as well as onto the bridge 16, at regular intervals corresponding to the standard side perforations of the continuous forms forming the packages to be spliced, cylindrical holes 18 are provided forming the seat for tapered pins 19; the latter are vertically movable between a rest position in which the pins 19 are completely housed in their respective holes 18 and an operating position in which the pins 19 protrude from the surface of the supporting plane 12.

For the actuation of the pins 19 between the two aforesaid positions conventional means can be used, such as for instance pneumatic cylinders schematically represented by the reference 20.

In a position centered onto the aforesaid terminal edge, as well as at a free end of the plate 18, two devices are mounted for the cutting of the self-adhesive tape consisting of wire electrical resistances 21 which are energizable by means of suitable electrical connections and are also movable with the pins 19 for instance by means of pneumatic cylinders, between a rest position and an operating position in which pins 19 are raised, although only a small distance, with respect to the supporting plane 12, thus cutting the self-adhesive tape which during the splicing operation covers the same resistances acting as cutting blades.

Figure 2:
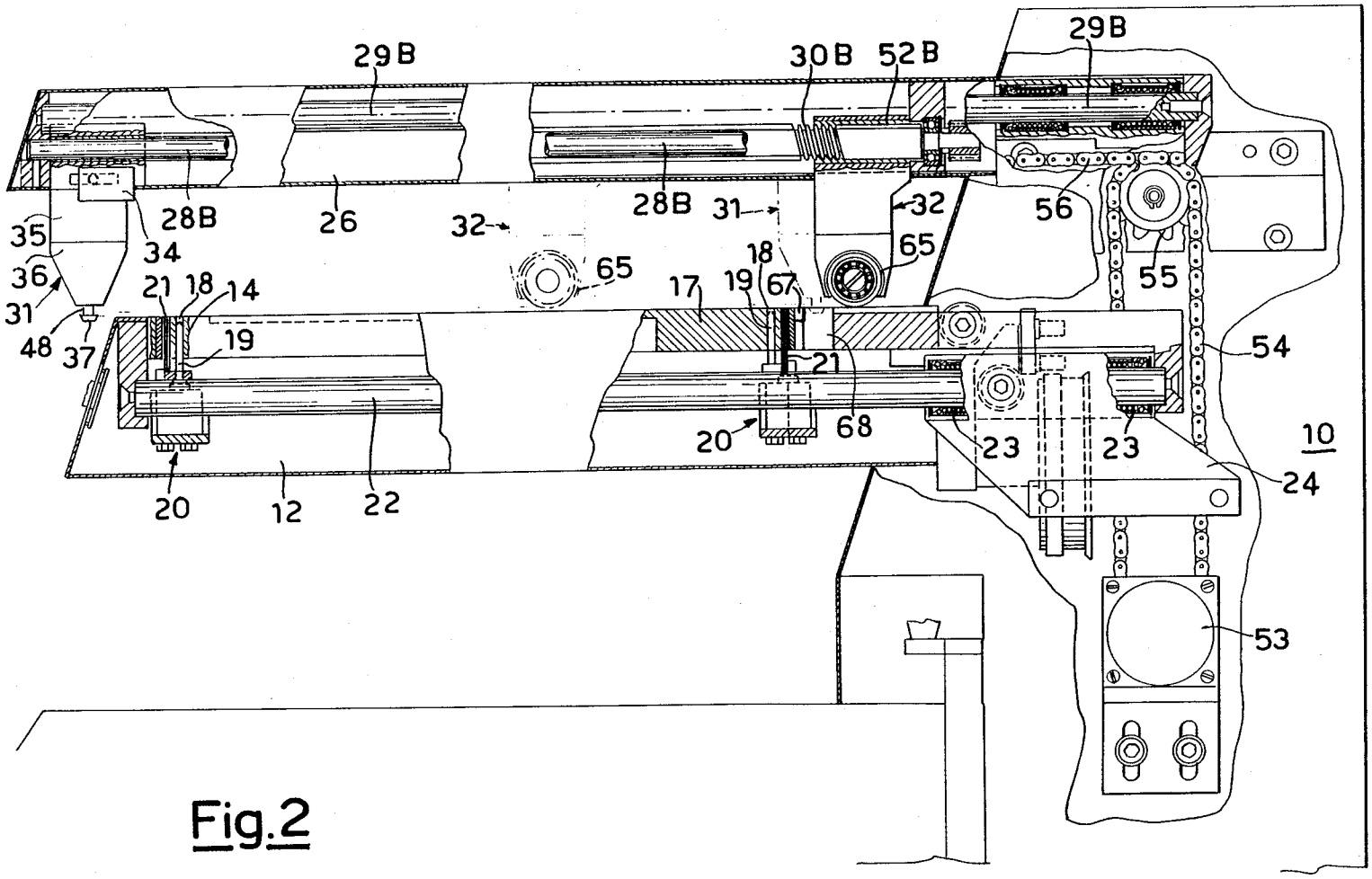
FIG. 2 is a partially longitudinal cross-section view of the device of FIG. 1.

As seen from FIG. 2, for sliding of supporting plane 12 two symmetrical guiding and supporting bars are provided, cooperating with ball bearing sleeves 23, fixed by means of brackets 24 to the casing 10. The supporting plane 12 has connected thereto, by means of shoulder 25, a splicing head enclosed by a cover 26. The shoulders 25 are slidably mounted onto guiding and supporting bars 28 (A-B) symmetrically positioned and protruding in a cantilevered fashion from the bottom plate 27. From the same plate two guiding and supporting sliding bars 29 (A,B) protrude in a cantilevered way as well as two screw threaded bars 30 (A,B).

The three bars 28B, 29B and 30B support a gripping and dragging device 31 for sliding and gripping of the tape, and reference numeral 32 indicates a pressing device.

By firstly considering the gripping and dragging device 31 for the self-adhesive tape 72, it comprises a block 33, substantially L-shaped, to which a pneumatic actuating cylinder 34 is rigidly connected.

A support 35 is mounted to block 33, so that support 35 is cross-wise slidable. From a comparison of FIGS. 3 and 4, it is clearly seen how support 35 is displaced in a cross-wise direction by means of cylinder 34 between the rest position of FIG. 3 and the operating position of FIG. 4.

Obviously the pneumatic cylinder 34 is shown in simplified form but it is evident that it cooperates with a double effect piston fastened to the support 35.

Two gripping and dragging elements, respectively 36 and 37, are fastened to the support 35, the fastening being carried out so that the upper element 36 is vertically displaceable with respect to the support 35 and so that the element 37, hereinafter called pliers element, is vertically displaceable with respect to the gripping element 36.

More specifically the element 36 comprises a cylindrical hole 38 vertically aligned with a cylindrical hole formed in the support 35, and stem 39 is seated into the two holes. Stem 39 forms part of a piston 40 housed in the cylinder 41 which is provided in the body of the support 35 and is fed in a controlled manner by means of air pressure supplied through the duct 42.

The stem 38 of the piston 39 is rigidly connected at its end to the gripping element 36 and a spring 43 opposes the downwardly displacement of the piston 40 and thus of the stem 39 reacting between the piston and the seat 44 provided in the support 35.

In turn the pliers element 37 is rigidly connected through a stem 45 to a piston 46 slidable into a cylinder 47 provided in the gripping element 36, the displacement of the piston 46 being controlled by air pressure fed to the duct 48 and being resiliently opposed by a contrasting spring 49.

Figure 4:
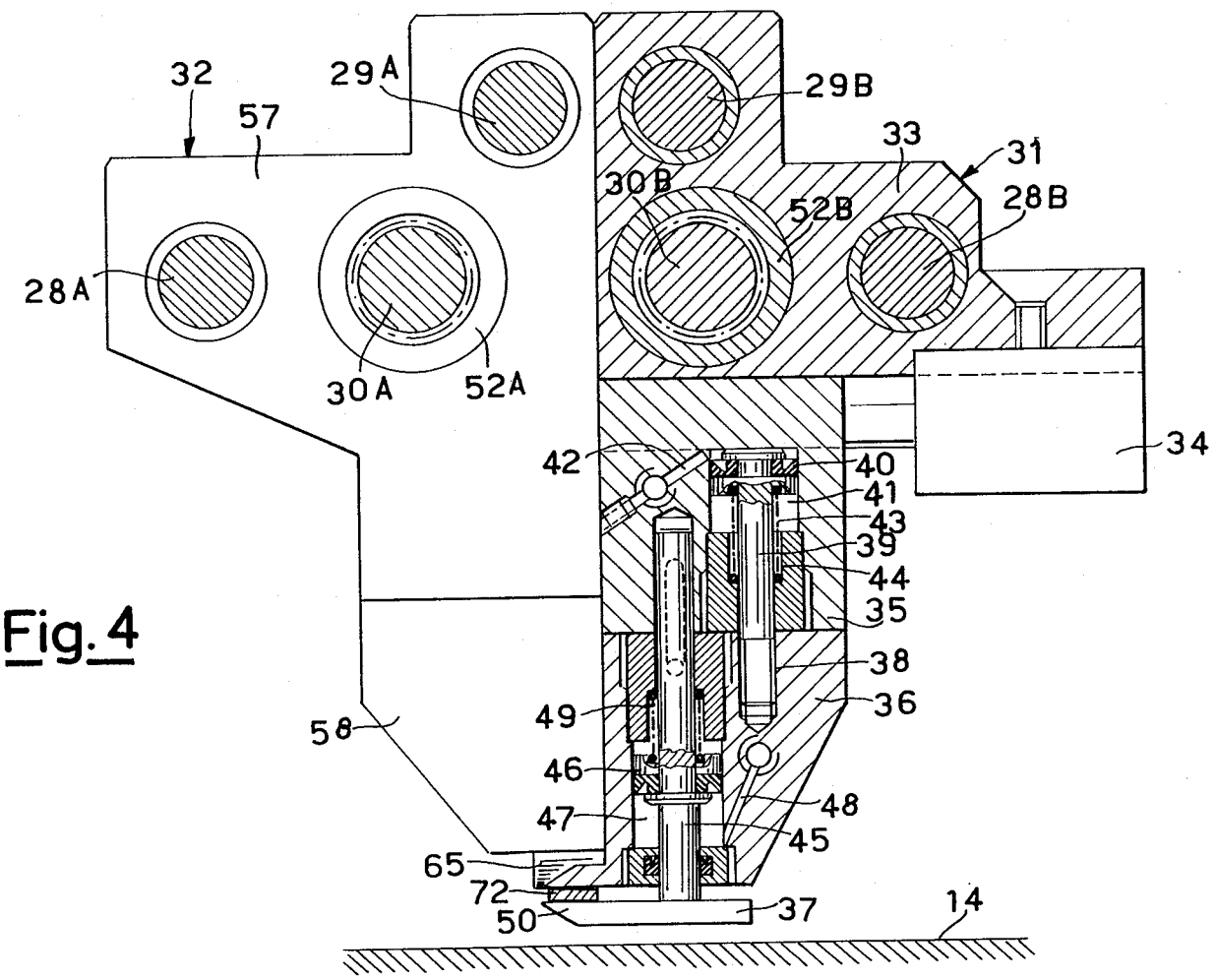
FIGS. 4, 5, 6 and 7 are views like FIG. 3 of the device of FIG. 1 in the several operating positions.

It is lastly to be observed that the pliers element 37 has the end shaped as a tapered pallet 50, whereby in the position of FIG. 4 namely with the support 35 displaced into the operating position, the pliers element 37 is positioned across the contacting and splicing line, indicated by the reference 51 in FIG. 1.

The movement of the gripping and dragging device 31 along the bars 29B, 28B is controlled by an internally threaded sleeve 52B, rigidly fixed to the block 33, the screw threaded bar 30B being rotated by means of a kinematic device positioned at rear end and actuated from a reversible electrical motor 53 through the chain 54, the pinion 55 and the chain 56. Since it is a motion transmission of conventional type, a more detailed description is not necessary, it being meant that the screw threaded bar 30B is rotated in either direction for the number of rotations needed to sequentially displace the screw threaded sleeve 52B and consequently the gripping device 31 in the several desired positions.

In turn the pressing roller device 32 comprises a block 57 also L-shaped as the block 33, with respect to which it is mirror like symmetrically as regards the engagement with the bars 28A, 29A and the actuation through the screw threaded bar 30A and the screw threaded sleeve 52A cooperating therewith.

Figure 6:
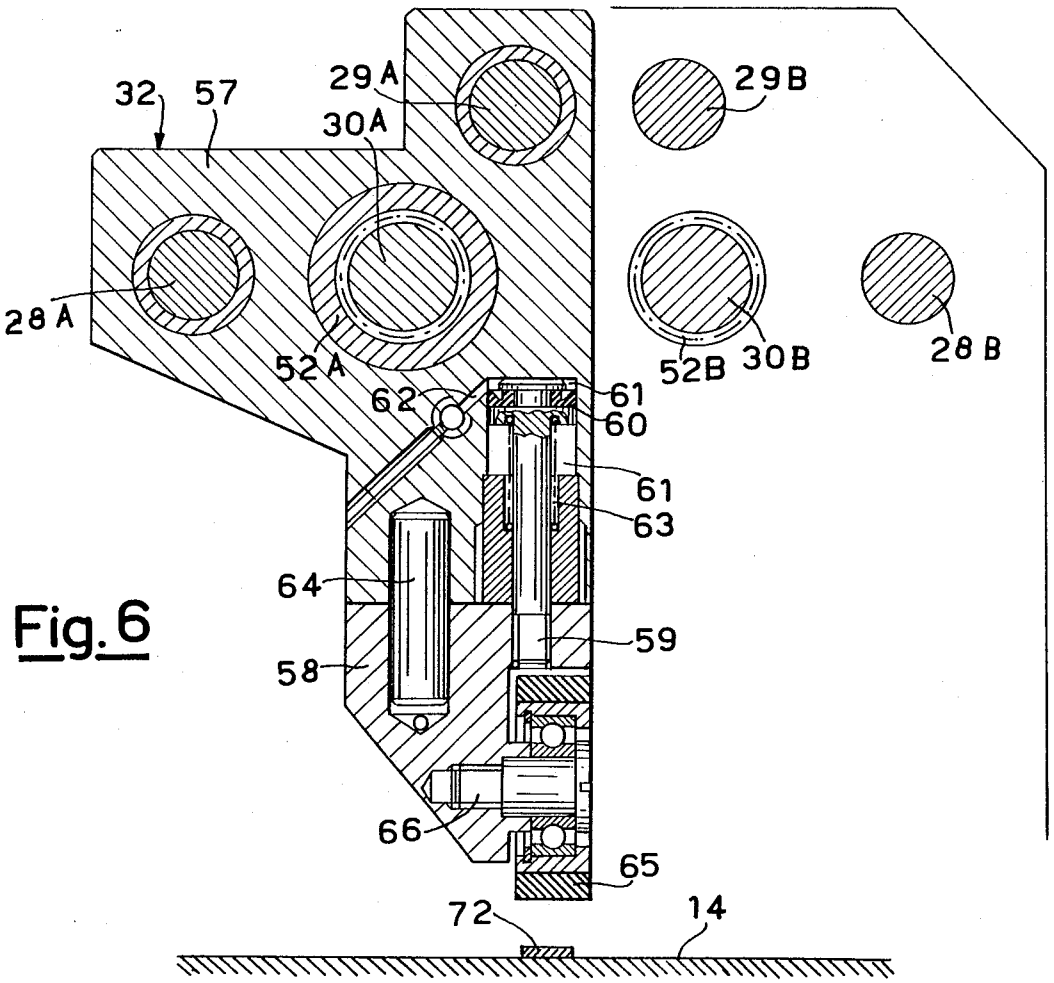
Figure 7:
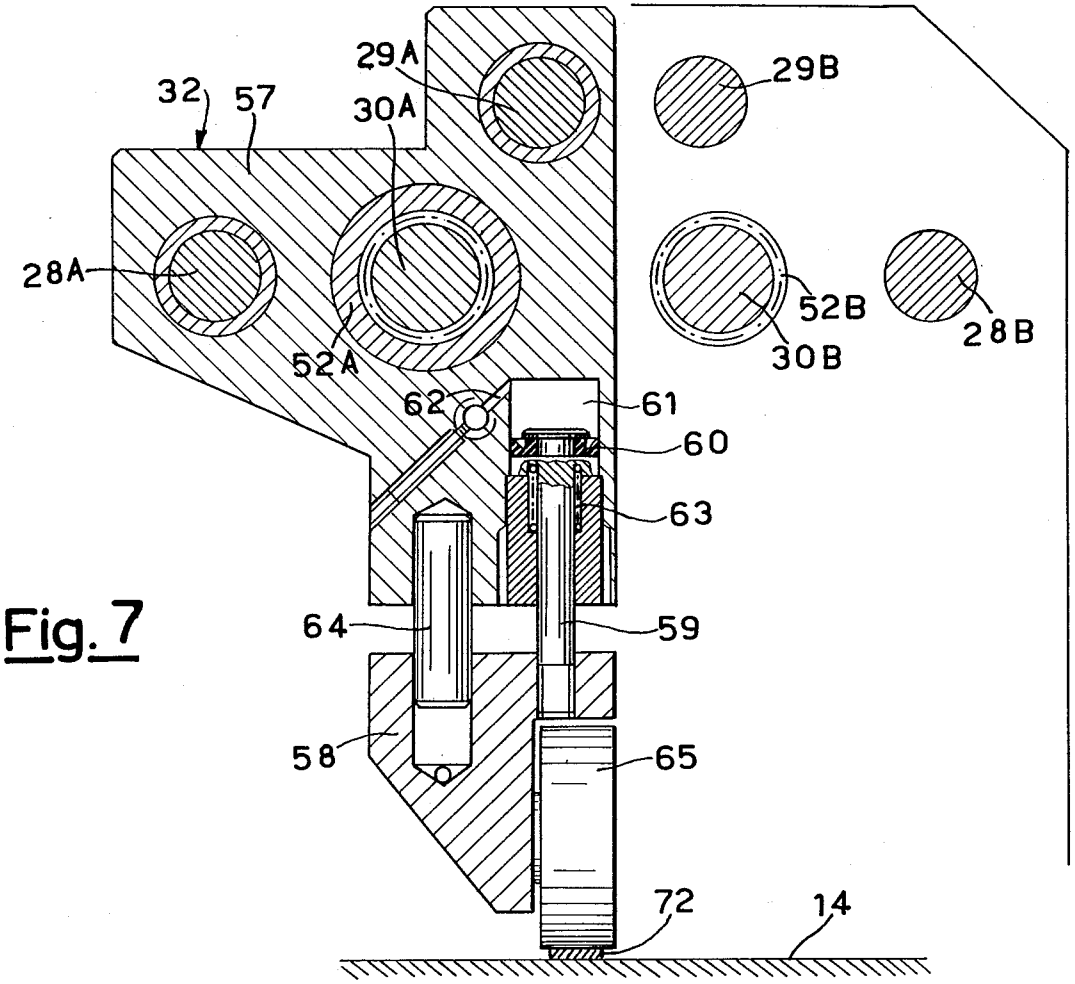

A support 58 rigidly fastened to the lower end of the block 57 is vertically movable between the rest position of FIG. 6 and the operating or pressing position of FIG. 7.

To this end the support 58 is rigidly connected to the end of the stem 59 of the piston 60 housed into a cylinder 61, the stem being slidable within a cylindrical hole formed in the base of the block 57.

For the actuation of the piston 60, a feed 62 of air pressure, is provided whereas the operating displacement of the piston 60 is opposed by a spring 63.

A pin 64 prevents the support 58 from rotating around the axis of the stem 59 and a pressure roller 65, covered by a suitable anti-adhesive material, is mounted to the support 58 by means of the pin 66, the roller being positioned so as to be placed across the splicing line 51 and having an axial length corresponding to that of splicing self-adhesive tape 72. The latter is drawn from a bobbin housed in the supporting plane 12, which is moreover provided with the control photocell 67 fastened to the displaceable plane 17 and having the subsequently described function. Considering now the operation of the device according to the invention it is first of all to be pointed out that it must be retractable so that, once the splicing operation is carried out, the package from which the first sheet has been drawn can be freely displaced in substitution of that feeding the printer, when the latter package is exhausted.

For the same reason the pins 19 must be retractable, since they, when occupying the protruding position serve to position with precision the two sheets to be spliced so that their head edges are exactly approached at the splicing line 51, without hindering the return or withdrawal of the splicing device once a displacing operation is carried out, for the above indicated reasons.

In order to carry out a splicing operation the splicing plane 12 is extracted, by displacing it along the guiding and sliding bars 22, whereby also the splicing head is extracted.

At that point the gripping and dragging device 31 is in the withdrawn position, shown by dashed lines in FIG. 2, whereas the pressing roller device 32 is in the position shown by solid lines in the same figure. Then, if necessary, the adjustment of the position of the plate 17 and of the bridge 16 is carried out, as a function of the size of the sheets to be spliced and the pneumatic devices 20 are actuated causing the pins 19 to come out of the holes 18.

As clearly shown in FIG. 1, onto the supporting plane 12 there are clearly and exactly identified the positions of the two sheets to be spliced, which are obviously positioned by hand, without difficulty.

At that point, the gripping and dragging device 31, still in the initial position, is actuated.

Figure 3:
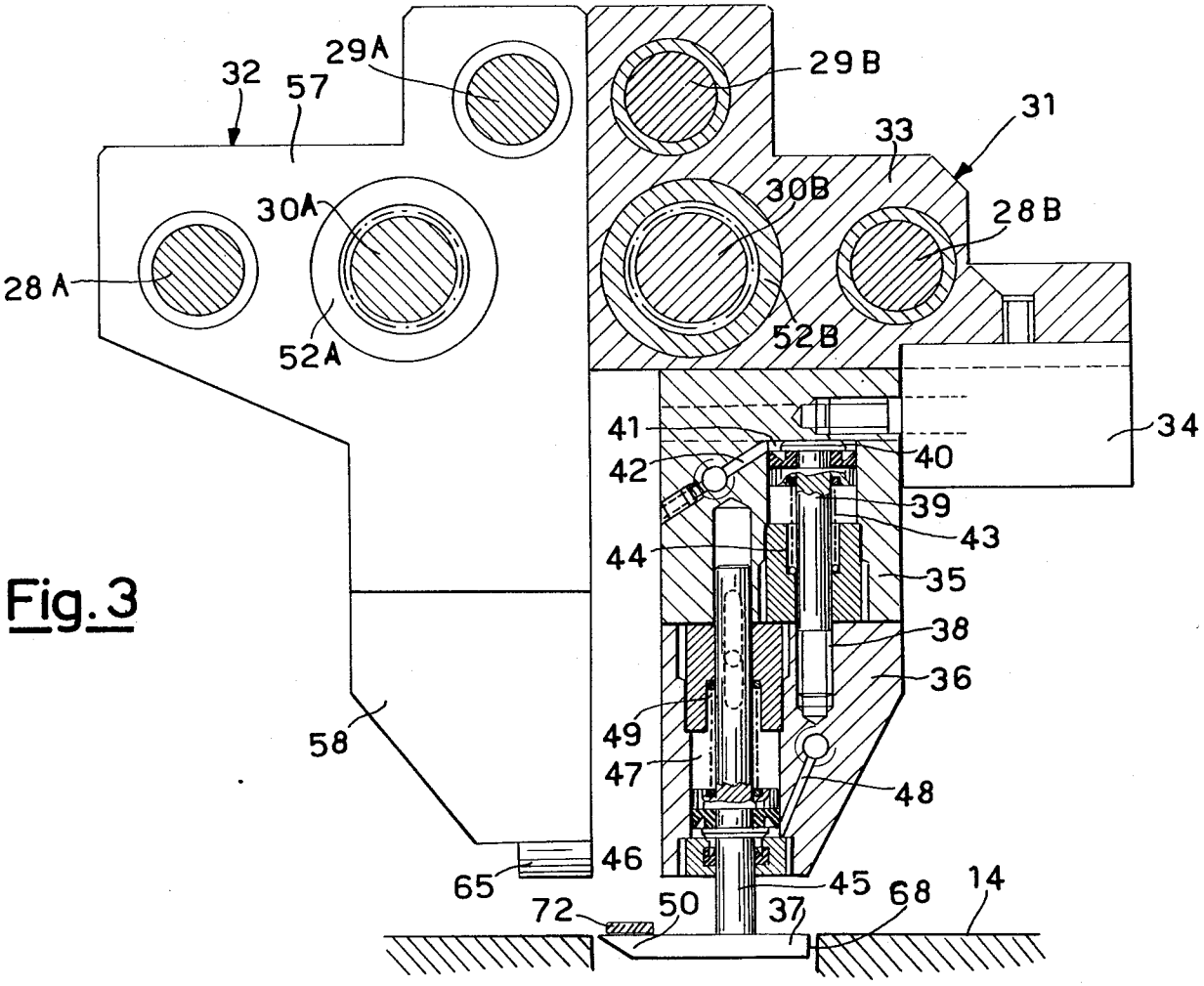
FIG. 3 is a partial transverse cross-section of the device of FIG. 1.

The first operation is that of the actuation of the piston 46, whereby the pliers element 37 is lowered with respect to the supporting plane so as to be removed from the gripping element (FIG. 3).

Actuation of cylinder 34 causes the support 35 to be displaced to the left (looking at FIG. 3), and the pliers element then takes the position below the self-adhesive tape 72, the free end of which, resulting from the next preceeding splicing operation, remained laid down between the cutting resistance 21 and residual rear part of the supporting plane 12. Otherwise stated the pliers element 37 is inserted below the tape 72 in the space indicated by the reference 68 in FIG. 2.

At that point the piston 46 is released and the pliers element 37 owing to the action of the spring 49, returns upwardly towards the gripping element 36, whereby the self-adhesive tape 72 is gripped (FIG. 4).

The device 31 is now ready for laying the tape 72 with the adhesive surface downwardly directed and this operation is carried out by controlling the rotation of the screw threaded bar 30B, whereby the screw threaded sleeve 52B and the block 33 are displaced towards the end of the splicing head until the terminal edge of the supporting plane is trespassed, then stopping in the position of the device 31 as illustrated by solid lines in FIG. 2.

Figure 5:
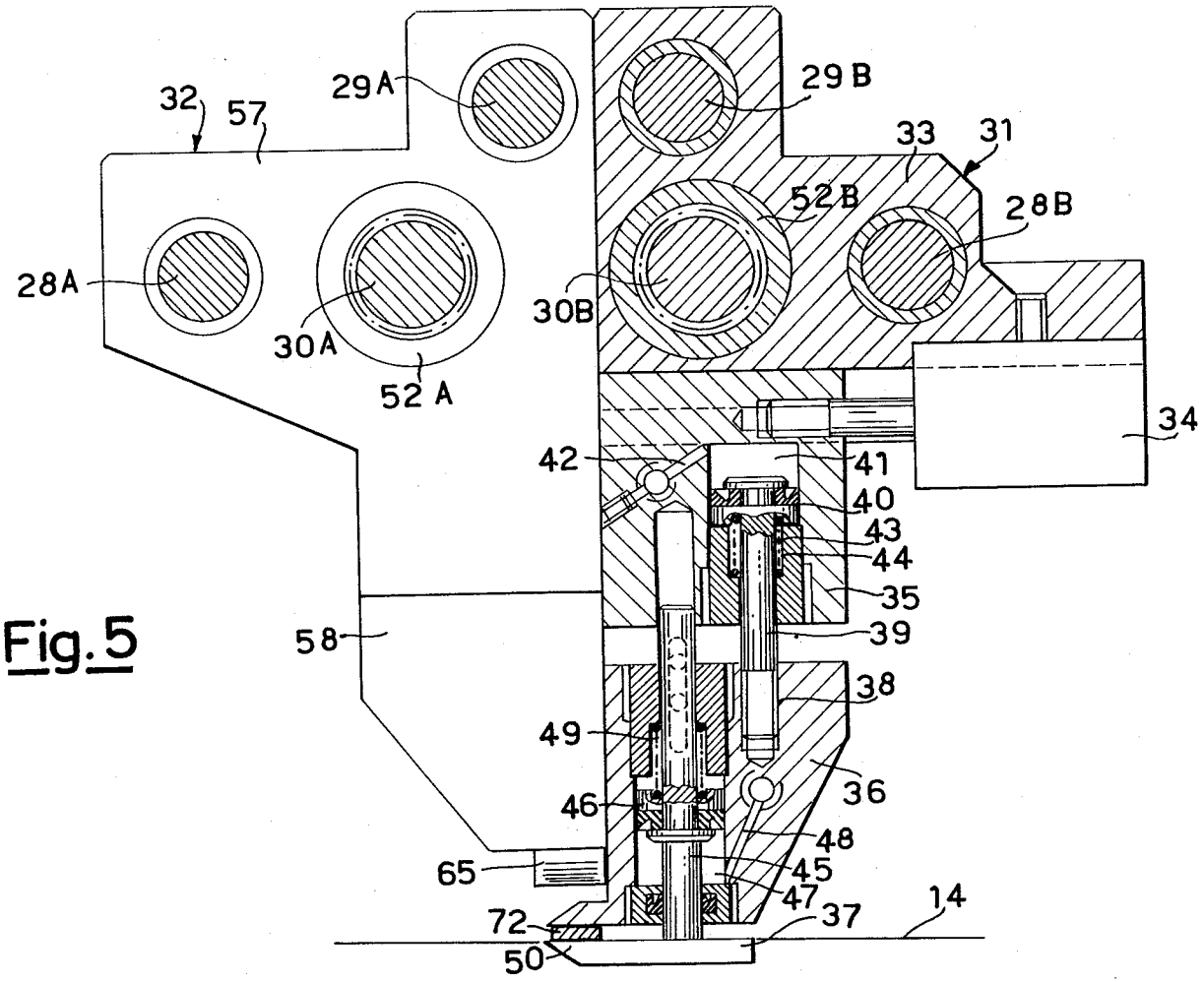

At that point the piston 40 and cylinder 41 assembly is actuated, whereby the gripping element 36 and therewith the pliers element 37, by which the end of the adhesive tape 72 is strictly gripped, are displaced downwardly reaching the position shown in FIG. 5.

As a consequence, the self-adhesive tape 72, laid down along the contact or splicing line 51, is lowered and comes into contact with the adjacent edges of the two sheets to be spliced.

In this condition, the pressing device is actuated by rotating the screw threaded bar 30A, by which the displacement of the block 57 and thus of the device 32, starting from the position illustrated in solid lines in FIG. 2, is caused to take place.

When the roller 65 passes onto the photocell 67 the cylinder 61 and piston 60 assembly is actuated, whereby the support 58 and the roller 65 are lowered into a pressing engagement with the back side of the adhesive tape 72, already applied onto the two adjacent edges of the two sheets to be spliced and retained by the gripping and dragging device which is still in the condition of FIG. 5 beyond the fore-end of the supporting plane 12.

When the roller 65 and consequently the device 32 terminate the pressing run, which can be signalled for instance by means of an end microswitch, the cutting resistances 21 are energized, namely the electrical power is switched on and the same resistances are pushed upwardly thus cutting the adhesive tape 72 flush of the said edges of the two sheets to be spliced. At that point the cylinder and piston assembly 60,61 is deenergized, whereby under the effect of the springs 63 the support 58 and the roller 65 are lifted with respect to the plane 12; thereafter the screw threaded bar 30A is rotated in the opposite direction and the device 32 comes back to the rest position.

At that point the cylinder and piston assembly 41, 40 is deenergized, whereby under the effect of the spring 44 the element 36 and the pliers element 37 are raised together above the supporting plane 12.

Then the cylinder 34 is actuated in an opposite direction with respect to the preceding one, thus bringing the support 35 into the position of FIG. 3, and lastly the bar 30B is rotated in an opposite direction whereby the device 31 is brought back to the initial position.

The last operation is that of deenerginizing the pneumatic cylinders 20 whereby the pins 19 are lowered with respect to the supporting plane 12, thus causing the spliced sheets to be freed, and lastly the supporting plane 12 is brought back together with the splicing head.

As shown in the FIG. 1, the front panel of the splicing plane 12 is provided with control push buttons, it being meant that the operating sequence can be made totally automatic, without manual intervention, apart from that of positioning the two sheets to be spliced and the actuation of the push button for starting the splicing cycle.

It is lastly meant that modifications and variations which are conceptually and mechanically equivalent are possible and foreseable without departing from the scope of the invention.

I claim:

1. A splicing device for sheet material, of the type in which head edges of two sheets to be spliced are approached to each other onto a supporting plane along a splicing line and maintained in position by engagement means for engaging side perforations along side edges of the two sheets; and wherein means are provided for drawing a self-adhesive tape from a source thereof and for applying it across a splicing line; comprising:

plier means for gripping and dragging of the self-adhesive tape for movement of the tape along and across the splicing line above said supporting plane;

pressing roller means mounted above said supporting plane and movable along and across said splicing line;

said plier means comprising first and second gripping elements vertically superimposed relative to each other and vertically movable with respect to each other between a removed or release position and a gripping or approached position, said first gripping element being pallet shaped and being positioned at a lower height with respect to said second gripping element, said second gripping element being mounted to a first supporting means provided with means for controlling vertical displacements of said second gripping element between a raised position and a lowered position;

said first supporting means being horizontally movable between a rest position with respect to said splicing line and an operating position wherein said first and said second gripping elements are vertically aligned and positioned across said splicing line, said second gripping element being in turn provided with control means for the displacement of said first gripping element between said removed or release position and said gripping or approached position with respect to said second gripping element;

said pressing roller means being mounted to second supporting means provided with control means for the displacement of said pressing roller means between a raised position with respect to said supporting plane and an operating position in which said supporting plane is engaged thereby with a predetermined pressing force;

said supporting plane including adjustment means for the positioning of said engagement means for the side perforations of the sheets to be spliced as a function of the size of the same sheets and means for cutting of the self-adhesive tape at the side edges of the sheets to be spliced; and motor means for operating displacement of said plier means and said pressing roller means along said splicing line.

2. A device according to claim 1, wherein the sheets to be spliced are respectively the last and the first sheets of two packages of continuous accordian-like folded forms.

3. A device according to claim 1, wherein said supporting plane comprises a movable plate positioned in a bridge-like manner between two longitudinal sides of said supporting plane and is displaceable as a function of the size of the sheets to be spliced with respect to a terminal edge of said supporting plane.

4. A device according to claim 3, wherein said engagement means comprises pins movable between an operating position in which the pins protrude, at mutual predetermined spacings, from said supporting plane and a rest position lowered with respect to said supporting plane, and including means for actuation of said pins between said two positions.

5. A device according to claim 4, wherein said means for actuation includes pneumatic cylinders.

6. A device according to claim 4, including resistance means at the ends of said splicing line in a position externally adjacent to the side lines, said resistance means comprising an electrical resistance wire for cutting of the self-adhesive tape, said resistance means being connected to a source of electrical power and being movable between a lowered or rest position and an operating position protruding from said supporting plane.

7. A device according to claim 6, including pneumatic cylinder means for actuating said resistance means between said two positions.

8. A device according to claim 1, wherein said supporting plane is slidably mounted onto guiding and sliding symmetrical bars for sliding motion of said supporting plane between an operating position in which the plane protrudes from a bottom plate in a cantilevered fashion and a withdrawn rest position.

9. A device according to claim 1, including a splicing head rigidly connected to said supporting plane, said splicing head being slidable together with said supporting plane between an operating position in which said plane protrudes from a bottom plate in a cantilevered fashion relative to said supporting plane and a withdrawn rest position.

10. A device according to claim 9, including two guiding and sliding symmetrical bars for slidably supporting said splicing head in a cantilevered manner.

11. A device according to claim 10, wherein said plier means and said pressing roller means are respectively rigidly connected to two supporting blocks, each said supporting block being slidably mounted on a pair of bars, and said motor means controlling the displacement of said supporting blocks along said pairs of bars.

12. A device according to claim 11, wherein said motor means comprises a screw threaded bar for each said block parallel to said pairs of bars and rotatable in a controlled manner in both rotation directions, and an internally screw threaded sleeve rigidly connected to each said block coupled to each respective screw threaded bar with an internal and external threaded coupling.

13. A device according to claim 12, including reversible electrical means for said motor means for the rotation through a kinematic chain of each said screw threaded bar.

14. A device according to claim 11, wherein said plier means is rigidly connected to a first one of said blocks through said first supporting means, said first block also being connected to first pneumatic piston and cylinder means for the displacement of said first supporting means between its said rest and operating positions.

15. A device according to claim 14, including pneumatic piston and cylinder means coupled to said first supporting means for the displacement of said second gripping element between said lowered and raised positions, and counteracting spring means for pushing said second gripping element towards the raised position.

16. A device according to claim 14, wherein said pressing roller means is fixed to the other of said blocks, and including pneumatic piston and cylinder means for said other of said blocks for the displacement of said pressing roller means between its said operating and raised positions, and counteracting spring means for pushing said pressing roller means towards its said raised position.

17. A device according to claim 16, including centering pin means between said other of said blocks and said pressing roller means for maintaining said pressing roller means in an aligned position with respect to said splicing line.

18. A device according to claim 16, including means sensing the position of said supporting plane connected to said supporting plane for actuating said cylinder and piston means of said other of said blocks.

19. A device according to claim 18, wherein said sensing means includes a photoelectric cell.

20. A device according to claim 1, including a pneumatic piston and cylinder assembly for said second gripping element for the displacement of said first gripping element between said removed or release position and gripping or approached position, and counteracting spring means for urging said first gripping element towards said gripping or approached position.

21. A device according to claim 1, wherein said pressing roller means comprise a support having a roller coated with anti-adhesive material.

* * * * *